United States Patent [19]

Michael et al.

[11] 3,961,684

[45] June 8, 1976

[54] OMNI-DIRECTIONAL SOUND SYSTEM

[75] Inventors: Stanley H. Michael, Miami, Fla.; Hans J. Weilandt, Clark; Ralph R. Soupe, Little Falls, both of N.J.

[73] Assignee: Turnsound Corporation, Maplewood, N.J.

[22] Filed: May 23, 1974

[21] Appl. No.: 473,089

[52] U.S. Cl. ..... 181/143

[51] Int. Cl.[2] ..... G10K 7/00

[58] Field of Search..... 181/143, 176; 179/1 J; 84/1.25

[56] References Cited

UNITED STATES PATENTS

| | | | |
|---|---|---|---|
| 2,813,928 | 1/1957 | Mizrahi et al. | 181/143 |
| 2,995,054 | 8/1961 | Leslie | 181/143 |
| 3,058,541 | 10/1962 | Leslie | 181/143 |
| 3,303,904 | 2/1967 | Kelly | 181/176 |
| 3,483,945 | 12/1969 | Michael | 181/143 |
| 3,520,559 | 7/1970 | Ross | 181/143 |

*Primary Examiner*—Stephen J. Tomsky

[57] ABSTRACT

An omni-directional sound system having means to create a high compression zone of low-frequency sound and a speaker-baffle assembly rotatable in said zone and emanating high-frequency sound. A feature includes a grill assembly to create the compression zone. One embodiment includes two rotating speaker-baffle assemblies vertically spaced and another embodiment includes a pair of speaker-baffle assemblies rotating side-by-side. Another includes a speaker array directed to a common zone with a rotating speaker-baffle in that zone. Another embodiment includes a compact system having a drive motor arranged in the stationary speaker cone and directly connected to rotate the speaker-baffle.

5 Claims, 9 Drawing Figures

OMNI-DIRECTIONAL SOUND SYSTEM

FIELD OF INVENTION

The present invention relates to rotating speakers and more particularly to speaker assemblies having one or more stationary speakers and one or more rotating speakers adaptable for use as sound systems for musical instrument performers, public address systems, theater sound systems, nightclub performers, home entertainment, and the like.

BACKGROUND OF INVENTION

Conventional sound speaker systems are known which attempt to provide omni-directional sound by incorporating a stationary speaker and a turning speaker assembly located within a housing. It is conventional for high-frequency audio to emanate from the turning speaker assembly and the low-frequency audio to emanate from the stationary speaker. This is to accomplish an omni-directional and tremolo effect for the system. See for example U.S. Pat. Nos. 3,483,945; 2,887,000; and 2,995,054.

These known conventional systems are not free of problems. For example, in order to achieve the tremolo effect, multiple speakers are provided on a rotating drum or other equivalent arrangement which in certain size rooms causes unwanted standing waves that are particularly displeasing to the audience and to the performer. Another serious disadvantage is that these conventional systems are sensitive to unwanted feedback which will produce a high-pitch whistle or other unpleasant piercing sound until the pick-up microphone is removed from the speaker area. A still further disadvantage of the known systems is that a plurality of speakers must be used in the turning assembly in order to produce the tremolo effect. To avoid unwanted shaft vibrations, these speakers are either arranged in a drum-like configuration centered upon a central shaft or axis or, alternatively, a single speaker is provided with a counterweight or counterbalance to avoid the shaft vibrations. These arrangements necessarily increase the strength requirements and complexity of the support and bearing system for the respective support shafts. Furthermore, the multi-speaker rotating arrangement must be symmetrically arranged such that all speakers must rotate together and at the same speed and thereby they cannot interact one with another.

SUMMARY OF THE INVENTION

It is the primary object of the present invention to provide an omni-directional speaker system which avoids the aforementioned problems and provides a new and improved turning speaker arrangement with advantages not heretofore achieved in the art.

Specifically, the present invention provides a new and improved arrangement for mounting the individual speaker and baffle assembly for rotation relative to the stationary speaker without the need for counterbalance weights or tandem connections in drum-like housings for the turning speaker assembly.

This is accomplished by arranging the vertical mounting shafts for the turning speaker-baffle assembly in alignment through the center of gravity of the assembly.

Another aspect of the invention is to provide a grill assembly, with a predetermined distributed open area, that forms a pressure or compression chamber housing the turning speaker and communicating with the stationary speaker. Sound emanating from the grill assembly must emanate in all directions thereby enhancing omni-directional sound penetration dispersion, reinforcement and high-low frequency mix.

Another embodiment of the invention includes a turning speaker arrangement with at least one stationary speaker and at least two rotating speakers in which the speakers are arranged one above the other in alignment with the axis through the stationary speaker.

Another embodiment of the invention includes a turning speaker assembly in which there is provided at least one stationary speaker and at least two turning speakers arranged to rotate side-by-side.

A further embodiment of the present invention includes a turning speaker assembly in which a plurality of stationary speakers are arranged with their axes directed to a point above the symmetrical center line of the stationary speaker array and at least one rotating speaker arranged to rotate about said center line and located approximately at the intersection of the axes of said stationary speakers.

A further embodiment of the invention includes a compact turning speaker of the type described in which the drive motor for the turning speaker is mounted within the cone profile of the stationary speaker.

DRAWINGS

Other and further objects of the present invention will become apparent with the following detailed description when taken in view of the appended drawings in which.

DETAILED DESCRIPTION

Figure 1:
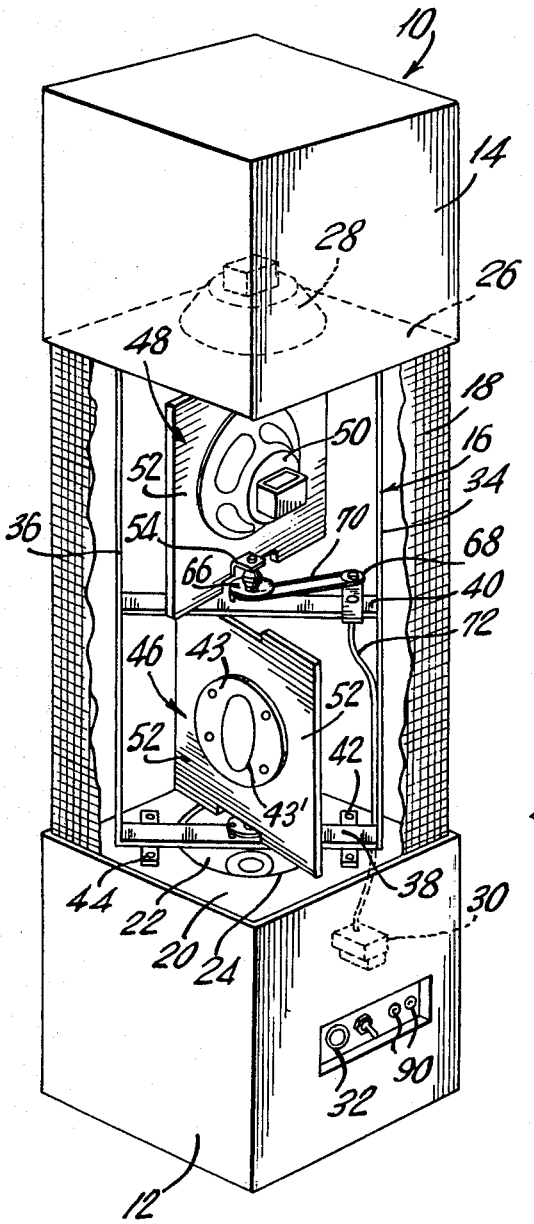
FIG. 1 is a partial cut-away perspective of a column speaker in accordance with the present invention.

With reference to FIGS. 1 through 5, a first embodiment of the invention comprises a column speaker generally indicated as 10, having a bottom speaker enclosure 12 and a speaker enclosure 14 mounted at opposite ends of a rotating speaker frame 16. A structural speaker grill assembly 18, preferably made of perforated metal or other suitable material, mounts between the top speaker enclosure 14 and the bottom speaker enclosure 12 to fully enclose the rotating speaker frame 16 and speakers mounted thereon. The open area of the grill is within the range of 30 to 70 percent of the total grill surface in relation to the total speaker power or size of the system.

The bottom and top speaker enclosures are vented and may be made of any suitable material such as ¾ inch plywood protected with vinyl fabric. The overall enclosure size is related to the diameter of the loudspeakers used, as known to those skilled in the art. The bottom enclosure 12 includes a top plate 20 to which bottom speaker 22 is mounted within the enclosure facing upward through an aperture 24 in the top baffle plate 20. Top enclosure 14 includes a bottom baffle plate 26 to which the top speaker 28 is mounted facing downward and preferably arranged co-axial with bottom speaker 22.

Bottom enclosure 12 also houses a gear motor assembly 30 and control panel assembly 32 further described below.

The rotating speaker frame 16 includes upstanding frame members 34 and 36 joined by a bottom cross piece 38, a mid cross piece 40, and a top cross piece 41. The bottom cross piece 38 and top cross piece 41 have integral (preferably welded) mounting feet such as 42 and 44 mounted to the bottom and top speaker enclosures by any suitable means such as screws or bolts. Rotating speaker frame 16 may be constructed of rectangular aluminum bar stock of sufficient strength to provide vertical support for upper enclosure 14 and two rotating speaker assemblies 46 and 48, which are mounted for rotation through 360 degrees about the vertical axis of the speaker frame, which preferably coincides with the axis through the bottom and top speakers 22 and 28, respectively. Frame members 34 and 36 can be circular rods in configuration to avoid unwanted sound reflections.

Each rotating speaker assembly includes a speaker 50 mounted to an apertured baffle 52. Dispersion lens or baffle 43 having an opening 43 mounts on the front face of the speaker. The lens opening can be any suitable shape such as, for example, oval shaped as seen in FIG. 1. Brackets 54 are fixed to the back of the respective baffle, preferably at the top and bottoms thereof, and have a top flange extending rearward of the baffle.

The suspension and rotation assemblies for the respective rotating speaker assemblies include a shaft and bearing assembly 58 and 60 rotatably held to the mid cross piece 40. The shaft is better seen in FIGS. 2 and 4. A second shaft section 62 is fixed to the inner part of flange 54 and shafts 60 and 62 are coupled through a flexible coupler 64 formed of suitable material such as rubber or the like to carry the weight of the rotating speaker assembly and impart mechanical rotation thereto upon rotation of shaft 60. The bottom flexible coupler cooperates with and is carried by thrust bearing 65 which serves to carry the weight of both rotating speaker assemblies.

Figure 2:
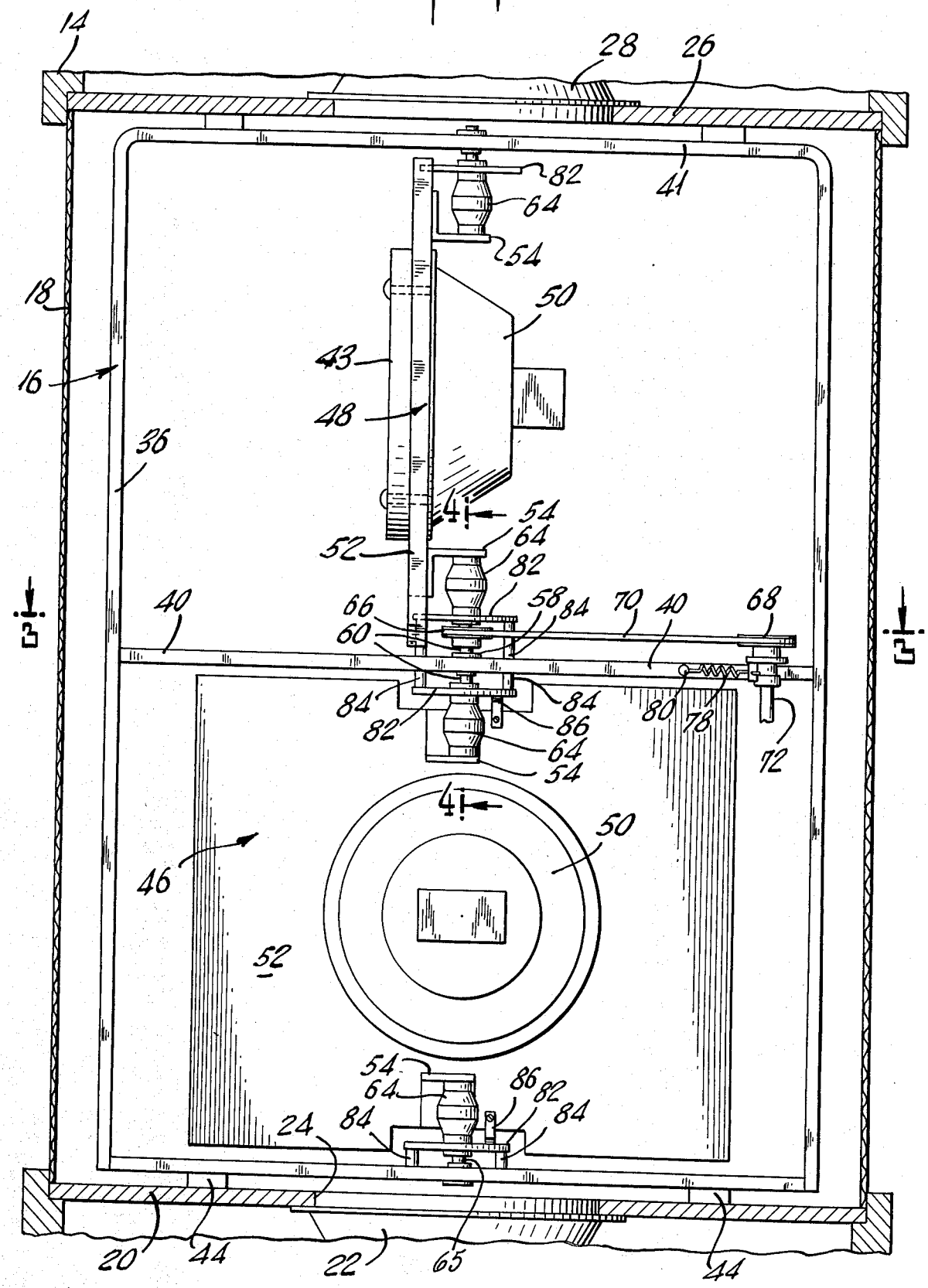
FIG. 2 is a side elevation of the turning speaker frame assembly of FIG. 1.
Figure 3:
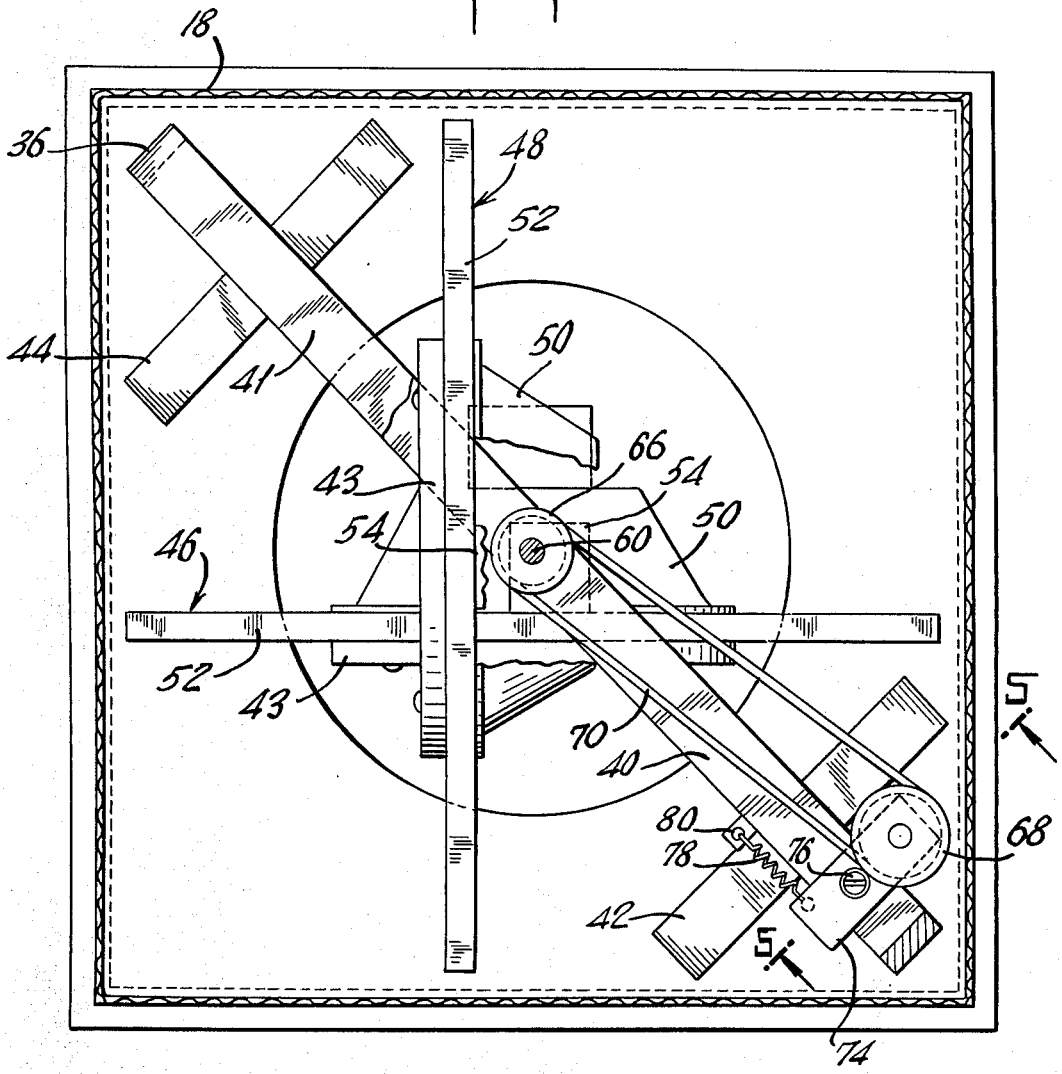
FIG. 3 is a top plan view taken along line 3—3 of FIG. 2.
Figure 4:
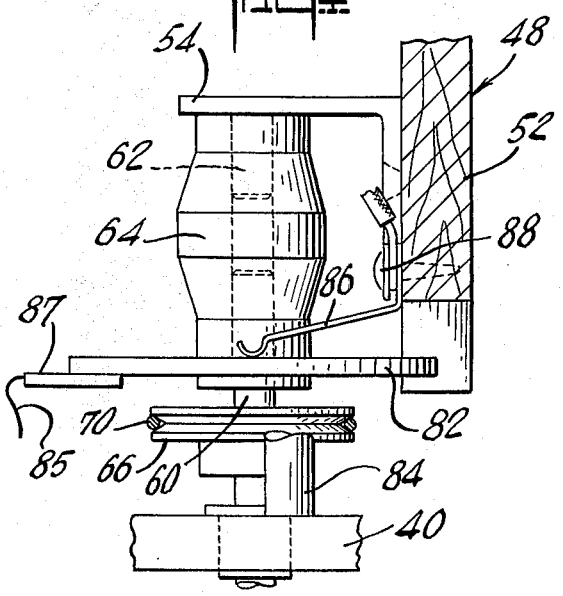
FIG. 4 is an elevation taken along line 4 of FIG. 2.
Figure 5:
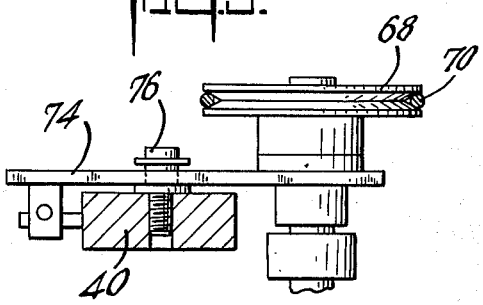
FIG. 5 is an elevation taken along line 5 of FIG. 3.

As better seen in FIGS. 2 and 3, the rotating shafts are aligned vertically with each other and vertically through the center of gravity of the rotating speaker and baffle assemblies 46 and 48 to avoid unwanted mechanical vibrations without the use of counter balances or the like.

The rotating speaker assemblies are driven mechanically by sheave 66 mounted on shaft 60 and sheave 68 coupled by drive belt 70. A flexible drive cable 72 drives sheave 68 and is powered by gear motor 30. In order to avoid variations in tension on drive belt 70, sheave 68 is rotatably mounted to cross bar 74 which in turn is pivoted to stud 76 held in cross piece 40. The other end of cross arm 74 is biased by tension spring 78 held to eye-piece 80 on cross member 40.

To apply electrical signals to the respective rotating speakers, a circular brass washer 82 is supported on the respective cross pieces of the frame assembly by insulated spacers 84. Washers 82 have a central aperture and make no contact with the associated flexible coupling 64. Each of the leads connected to the speaker coil is connected to opposite electrical wiper arms 86 by any suitable means such as screw 88 mounted to baffle 48. Wiper arm 86 is under spring tension and is arranged to ride along the top surface of washer 82 to maintain electrical contact during rotation of the speaker assembly. Input jack connection is made to washer 82 via lead 85 connected to terminal 87 mounted on washer 82 (see FIG. 4).

In operation, when the system is on by appropriate setting of the controls at the control panel 32, AC outlet power provides power to gear motor 30 through an on/off switch. Two signal input jacks 90 enable reception of the incoming electrical signals. Each speaker may be electrically isolated if desired to operate independently off of individual input signals or, alternately, the speakers may be coupled as desired. Rotational power is transmitted from the gear motor 30 through the flexible drive cable 72, sheaves 68 and 66 to rotate the two rotating speaker baffle assemblies 46 and 48 continuously through 360 degrees. Rotational speed may be controllable to control Doppler by provision of an additional control switch for gear motor 30. The speaker rotation is preferably within the range of 40 and 70 cycles per minute.

The angular position of one of the speaker assemblies with respect to the other may be set in predetermined relation. That is, both speaker assemblies may face in the same direction as they rotate or they may face in opposite directions as they rotate or at any intermediate angle, depending on the desired effect. One example of this setting is shown in FIG. 2, where the two rotating speaker assemblies are arranged at 90° relative to one another.

The incoming audio signal from the amplifier means (not shown) is applied to the stationary speakers 22 and 28 to produce low-frequency audio such as that below 1500 cps. Input signals are applied to the turning speaker assemblies through the stationary washers and wiper arm pick-ups as described above, which speakers produce high-frequency audio, that is, above 1500 cps. In this way, the stationary and turning speakers 22 and 28, in cooperation with the grill assembly 18, generate a high-compression chamber of high- and low-frequency audio sound. The low-frequency compression waves mix efficiently with the high-frequency emanations from the turning speakers and by virtue of the reflections off baffle plates 46 and 48 the sound emanating in all directions from the speaker system is reinforced, permitting optimum audience reception regardless of the direction and distance from the speaker system. As the baffles rotate, a fan effect within the compression chamber of sound further assists the sound mix and production of Doppler. The achieved 360° sound dispersion minimizes feedback, echo, standing waves, and reverberation. Since the design of the system avoids directional sound and thereby the detriments of feedback, a performer holding a pick-up microphone has the capability of listening to the same sounds that the audience receives. Another advantage is that the location of the rotating speaker system within a room or auditorium is not critical in establishing uniform sound coverage.

One example of a grill that assisted in producing a good sound compression chamber was made of 18 gauge perforated steel having ⅛-inch round holes on 3/16-inch staggered centers with 33 holes per square inch, thereby approximating 41 percent open area of grill surface. The chamber accommodated two 8-inch turning speakers and two 12-inch stationary speakers, totaling about 200 watts. Grill height was 28.50 inches and cross section square with side dimension of 14.84 inches.

Figure 6:
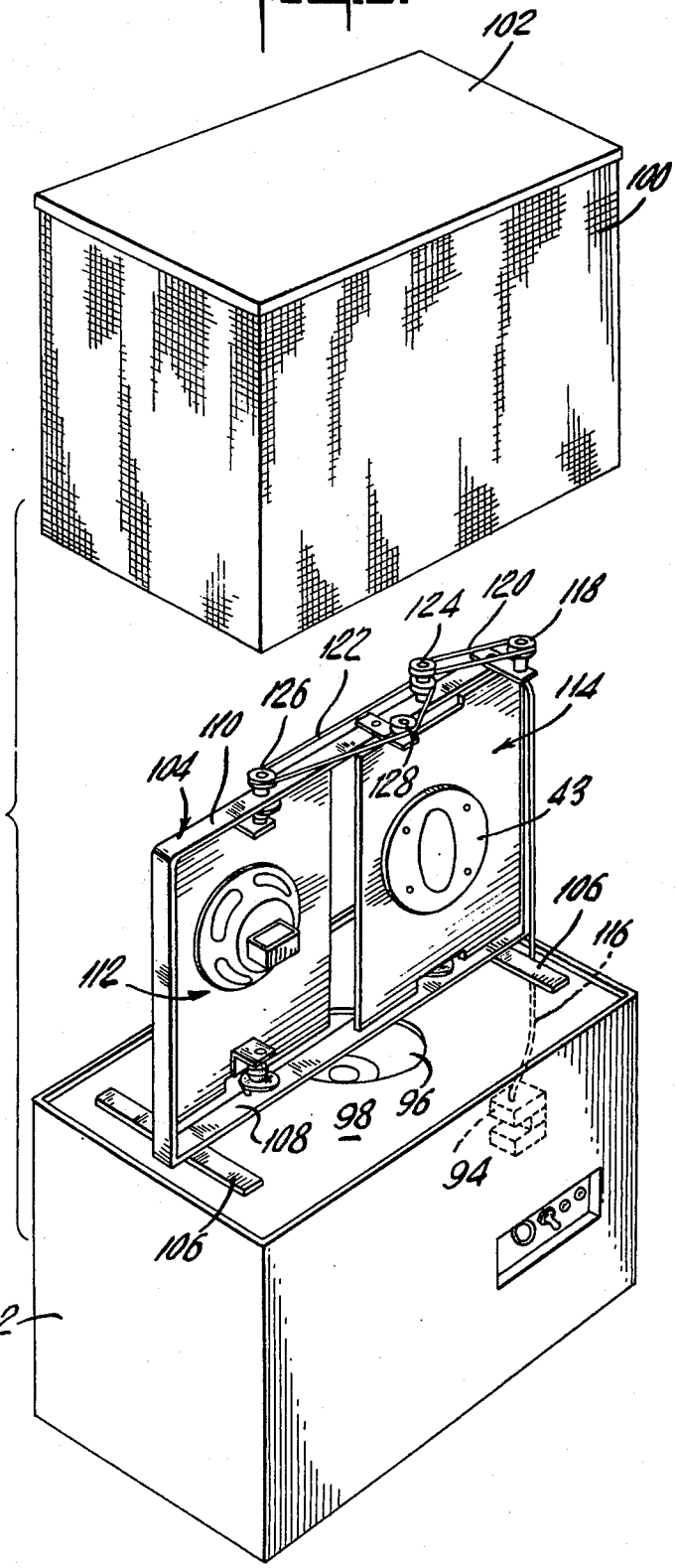
FIG. 6 is a view similar to FIG. 1 showing another embodiment of the present invention.

With reference to FIG. 6, another embodiment of the present invention includes a speaker enclosure 92 housing a gear motor assembly 94 and upwardly directed speaker 96 mounted to a top baffle plate 98. Enclosure 92 is vented and its size is selected in relation to the size of speaker 96 in the usual manner. A speaker grill assembly 100, which may be made of perforated metal, is fastened to a top board 102, which assembly mounts to the top of enclosure 92. A rotating speaker frame assembly 104 is enclosed within the grill assembly 100 and includes a rectangular frame welded on a pair of opposed feet 106 which in turn are mounted to the top baffle plate 98 of enclosure 92. The horizontal cross members 108 and 110 support two rotating speaker-baffle assemblies 112 and 114 generally as shown. The rotational and suspension assemblies as well as the electrical pick-up mechanisms for the respective speakers may be similar to that described in the embodiment of FIG. 1 and will not be described in further detail.

As can be seen in FIG. 6, the vertical axes of rotation for assemblies 112 and 114 are spaced on either side of the stationary speaker 96 and are arranged such that the rotating baffles may turn 360° without mutual contact with each other or with the frame member 104. A drive cable 116, driven by gear motor 94, couples into and drives sheave 118 and a series of drive belts 120 and 122, together with a plurality of sheaves 124, 126 and idler sheave 128 serving to maintain constant tension on drive belt 122. Turning speaker-baffle assemblies 112 and 114 may be arranged to turn in the same directions or opposite directions as desired and at a constant speed or at speeds different from one another if desired. In one embodiment the speakers are rotated in the same direction at a constant or variable speed which serves to achieve a Doppler or tremolo effect for musical instrumentation performances. The incoming audio electrical signal is applied as mentioned above with low-frequency audio emanating from speaker 96 and high-frequency audio emanating from the two turning speaker assemblies.

Figure 7:
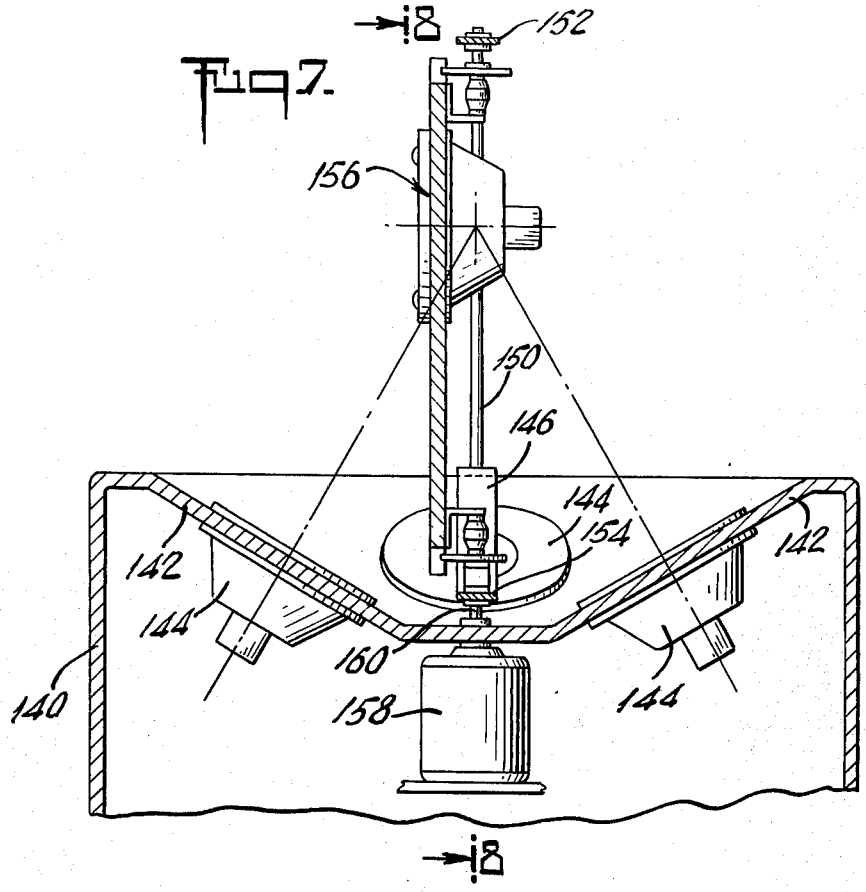
FIG. 7 is a view similar to FIG. 1, showing a further embodiment of the present invention with the grill covering removed.
Figure 8:
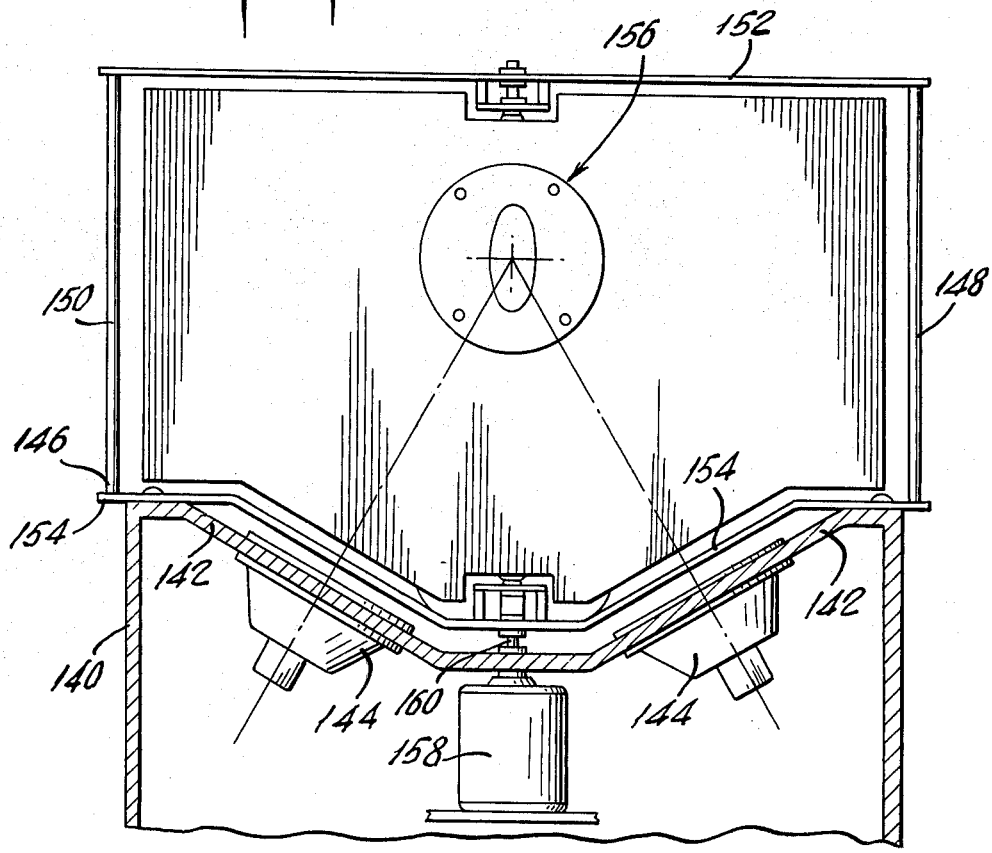
FIG. 8 is a sectional view taken along line 8—8 of FIG. 7.

A still further embodiment of the invention is shown in FIGS. 7 and 8. A bottom speaker enclosure 140 has a top baffle arrangement with four top surfaces 142 sloping toward the vertical center axis of enclosure 140. Each sloping surface 142 has mounted thereon a speaker 144, all of which have their axes directed toward an imaginary point above the center of enclosure 140 and the stationary speaker array.

A rotating speaker frame assembly 146 is provided with a pair of upstanding side pieces 148 and 150 mounted by any suitable means to the sides of enclosure 140. Top and bottom cross pieces 152 and 154 support a rotating speaker assembly 156 for horizontal rotation through 360° as described above. In one example, each stationary speaker 144 comprises an 8-inch speaker which produces low-frequency audio and the rotating speaker comprises a 12-inch speaker which produces high-frequency audio.

Bottom piece 154 has a V-shaped central portion that extends into the profile of the four stationary speaker array, generally as shown. The speaker and baffle assembly 156, carried by flexible coupler and a thrust bearing as described above, includes a baffle 157 having a bottom edge that follows piece 154 into the profile of the speaker array. Assembly 156 is driven by gear motor 158 mounted to the underside of the top center of enclosure 140 with its drive shaft 160 coupled to cooperate with the bottom flexible coupler. Electrical connections to the rotating speaker may be the same as described for the above embodiments.

In operation, the arrangement and orientation of the low-frequency stationary speakers 140 create a high-compression zone of low-frequency audio in the vicinity of and at a space zone which encompasses the rotating speaker-baffle assembly 156. The effect of this arrangement is to produce a highly uniform and powerful, mixed sound signal which has excellent penetration regardless of the direction and distance from the speaker system.

Figure 9:
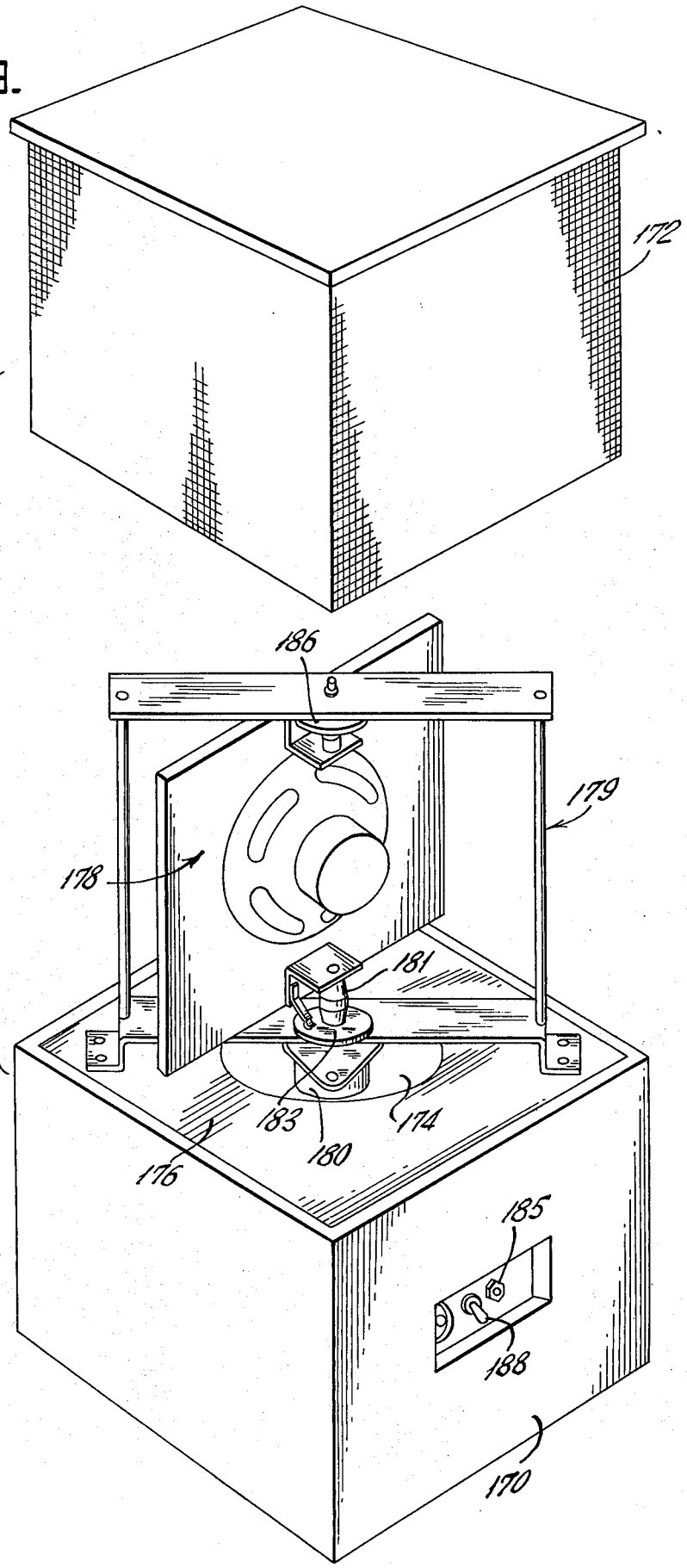
FIG. 9 is a view similar to FIG. 1 showing a further embodiment of the invention.

In FIG. 9, a compact turning speaker system is shown having a vented enclosure 170 and grill assembly 172. As described for the first mentioned embodiment, a grill assembly 172 enables the generation of a pressure chamber therein. A stationary low-frequency speaker 174 mounts below the apertured top 176 of enclosure 170. A turning speaker frame assembly 179 mounted on enclosure 170 carries turning speaker and baffle assembly 178 for complete rotation. The axis of rotation is through the center of gravity of assembly 178. A dispersion lens is provided on the front face of the turning speaker.

Gear motor 180 is mounted to the underside of bottom piece 182 of frame 179 with its drive shaft coupled to flexible coupler 181 and within the conical profile of speaker 174, but not in engagement with the speaker. Operation and speed of motor 180 is controlled by three-way switch 188. Motor 180 is electrically connected to frame 179 and washer 183 to serve as ground for the turning speaker. The audio electrical input signal is applied through input jack 185 to the turning speaker via the washer 186 and cooperating wiper (not shown) on the baffle speaker assembly 178, as well as stationary speaker 174.

In operation, low and mid range-frequency audio emanates from the lower speaker and high-frequency audio emanates from the turning speaker. These sounds are mixed within the pressure chamber created as described to produce reinforced omni-directional sound.

With reference to FIG. 1, it should be understood that each turning speaker can be driven at a selected speed and direction by an independent motor directly coupled thereto in the manner disclosed in the embodiment of FIG. 9.

Other and further modifications can be made to the exemplary embodiments herein disclosed without departing from the spirit and scope of the present invention. For example, if desired, electrical input to the turning speakers may be imparted through the shaft sections of turning speaker-baffle assembly by means of slip rings, wiper arms or the like in lieu of the washer arrangement as shown.

What is claimed is:

1. A turnable speaker system comprising, a. frame means, b. a speaker-baffle assembly including (1) a basket speaker, (2) a first baffle, for reflecting sound, external to and coupled to said speaker, and (3) a second baffle with at least one opening mounted to the front face of said speaker; said first baffle being arranged generally parallel to and near the front face of said speaker; said first baffle having an aperture within which an outer portion of said speaker is seated; said speaker-baffle assembly having a center of gravity within said speaker at a location rearward of said first baffle;

c. a pair of shaft members rotatably coupled in spaced relation to the frame means in alignment with one another to form a rotation axis;

d. mounting means including a pair of brackets mounted to the rear of said first baffle and extending rearward thereof and coupled to respective ones of said shaft members such that the rotation axis is substantially aligned through said center of gravity.

2. A turnable speaker system as set forth in claim 1, wherein said mounting means further comprises a pair of flexible couplings, each coupling supporting a respective one of said shaft members to said frame means.

3. An omni-directional sound system comprising an enclosure housing a stationary basket speaker having its front face arranged to direct sound through a surface of the enclosure, a grill assembly enclosing the space about said surface to form a chamber to receive sound from said stationary speaker, a turnable speaker-baffle assembly mounted for rotation within said chamber about a rotational axis, means for controllably rotating said assembly at a predetermined speed and direction, and wherein said speaker-baffle assembly includes an apertured baffle, a basket speaker mounted within the baffle aperture and the rotational axis being aligned through the center of gravity of the speaker-baffle assembly, and a second turnable speaker-baffle assembly within said chamber and mounted for rotation about an axis arranged in alignment with the first mentioned rotational axis, said axes being aligned with the axis of the stationary speaker, and means for rotating the first and second assemblies in predetermined directions and speeds relative to each other.

4. A system as set forth in claim 3 wherein the first and second assemblies are set at a predetermined angular position relative to each other and said means rotate said assemblies in the same direction at the same speed.

5. A system as set forth in claim 3 wherein a second enclosure is arranged on said grill assembly, a second stationary basket speaker in said second enclosure having its front face arranged to direct sound into said chamber toward said first stationary speaker and having its axis co-aligned therewith, the turnable speaker being adapted to produce high-frequency sound and the stationary speakers being adapted to produce low-frequency sound.

* * * * *